United States Patent [19]

Jones, Jr. et al.

[11] Patent Number: 5,074,320

[45] Date of Patent: Dec. 24, 1991

[54] CIGARETTE AND CIGARETTE FILTER

[75] Inventors: Elbert C. Jones, Jr., Sherrill's Ford; Thomas A. Perfetti, Winston-Salem, both of N.C.

[73] Assignee: R. J. Reynolds Tobacco Company, Winston-Salem, N.C.

[21] Appl. No.: 427,547

[22] Filed: Oct. 26, 1989

[51] Int. Cl.[5] ..... A24D 3/06; A24D 3/16

[52] U.S. Cl. ..... 131/331; 131/334; 131/341; 131/342; 131/336; 131/344

[58] Field of Search ..... 131/342, 344, 334, 331, 131/336, 365

[56] References Cited

U.S. PATENT DOCUMENTS

| | | | |
|---|---|---|---|
| 2,181,614 | 11/1939 | Striefling . | |
| 2,900,989 | 8/1959 | Davidson . | |
| 3,046,994 | 7/1962 | Schur . | |
| 3,319,630 | 5/1967 | Orrmins | 131/342 |
| 3,347,247 | 10/1967 | Lloyd . | |
| 3,400,723 | 9/1968 | Muller . | |
| 3,407,820 | 10/1968 | Westcott et al. | 131/334 |
| 3,669,126 | 6/1972 | Soussa et al. | 131/334 |
| 3,841,338 | 10/1974 | Horsewell et al. . | |
| 3,900,037 | 8/1975 | Horsewell et al. . | |
| 4,125,061 | 11/1978 | Goavec . | |
| 4,149,549 | 4/1979 | Grossman . | |
| 4,283,186 | 8/1981 | Keith et al. . | |
| 4,396,026 | 8/1983 | Grossman . | |
| 4,450,847 | 5/1984 | Owens . | |

OTHER PUBLICATIONS

*Tobacco Encyclopedia*, edited by Voges, TJI (1984), pp. 425–428.

*Primary Examiner*—V. Millin

[57] ABSTRACT

Cigarettes have filter elements which have a relatively low efficiency for filtering particulate matter of tobacco smoke and a relatively high pressure drop. Such filter elements are provided by shredding, gathering or pleating a sheet-like web of a paper which has a low air permeability and exhibits a pH above about 9. The paper used to provide the filter material of the filter elements incorporates a magnesium hydroxide filter.

43 Claims, 1 Drawing Sheet

CIGARETTE AND CIGARETTE FILTER

BACKGROUND OF THE INVENTION

The present invention relates to smoking articles, such as cigarettes, and in particular to filter cigarettes.

Popular smoking articles, such as cigarettes, have a substantially cylindrical rod shaped structure and include a charge or roll of smokable material, such as shredded tobacco (e.g., tobacco cut filler), surrounded by a paper wrapper, thereby forming a so-called "tobacco rod." It has become desirable to manufacture a cigarette having a cylindrical filter element aligned in an end-to-end relationship with the tobacco rod. Typically, a filter element is manufactured from cellulose acetate tow and plug wrap, and is attached to the tobacco rod using a circumscribing tipping material. Cigarettes having filter elements are referred to as "filter cigarettes."

A ventilated or air diluted cigarette normally includes a filter element having a zone of a predetermined permeability so that air can dilute drawn mainstream smoke which passes to the mouth of the smoker. One convenient method for providing air diluted filter cigarettes involves a so-called "on-line" laser perforation technique, whereby a row of vents is provided around the cigarette through the tipping material and plug wrap of the filter element.

Normally, gas phase components of tobacco smoke (e.g., carbon monoxide and nitrogen oxides) are reduced within the mainstream smoke of ventilated cigarettes. Furthermore, the FTC "tar" yields of ventilated cigarettes are reduced. However, filter elements also are relatively efficient for the removal of particulate matter from mainstream tobacco smoke, and as such, there is not provided a reduction in the ratio of the gas phase components of the mainstream smoke relative to the FTC "tar" yields of ventilated cigarettes.

Filter elements having low efficiencies for the removal of particulate matter from mainstream tobacco smoke have been proposed. However, a low efficiency filter element, in conjunction with the ventilation provided to the cigarette, provides a cigarette having a relatively low resistance to draw. Many smokers find cigarettes having low draw resistances frustrating and unacceptable. See, *Tobacco Encyclopedia,* edited by Voges, TJI (1984).

It would be desirable to provide a filter element for a cigarette, which filter element exhibits both a relatively low filtration efficiency for particulate matter of mainstream cigarette smoke and a relatively high resistance to draw.

SUMMARY OF THE INVENTION

The present invention relates to a filter element for smoking articles such as cigarettes. The filter element includes a filter material and a circumscribing outer wrap. Normally, the outer wrap is a paper plug wrap. The preferred filter material is a shredded, gathered or pleated paper. Such a filter element exhibits a relatively low filtration efficiency for particulate matter of mainstream tobacco smoke and a relatively high resistance to draw. Preferred filter materials for the filter element of the present invention include paper filter materials which have a low air permeability, exhibit a basic pH, and can be gathered or formed easily to form the filter element. Highly preferred paper filter materials include a metal hydroxide (e.g., magnesium hydroxide) filler.

Preferred filter elements exhibit a pressure drop of greater than about 40 mm of water at an airflow rate of 17.5 cc/sec. per 0.1 gram of filter material; and also exhibit a filtration efficiency for particulate matter of mainstream tobacco smoke of less than about 15 percent per 0.1 gram of filter material.

Filter elements of the present invention can be incorporated into a wide variety of smoking articles. One preferred smoking article includes (i) a charge of smokable material wrapped in paper to form a smokable rod, and (ii) a filter element of the present invention attached to one end of the smokable rod. A particularly preferred filter element includes at least two filter element segments, wherein one of the segments exhibits a relatively low filtration efficiency for particulate matter of mainstream tobacco smoke and a relatively high resistance to draw. A particularly preferred smoking article has the form of a cigarette having a relatively low porosity paper wrapper for the smokable rod. Another particularly preferred smoking article has the form of a cigarette which is ventilated or air diluted.

DETAILED DESCRIPTION OF THE PREFERRED EMBODIMENTS

Figure 1:
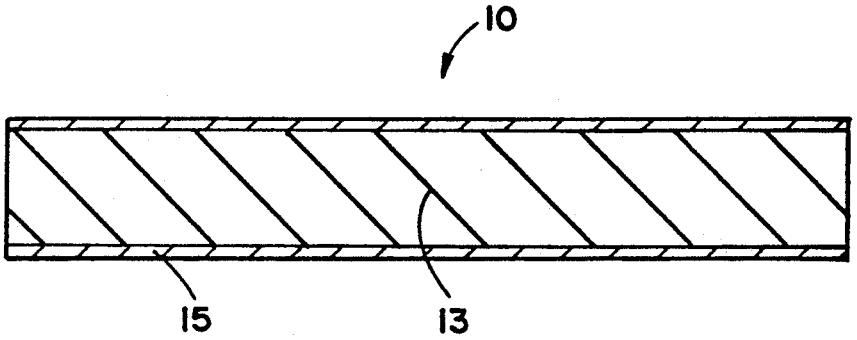
FIG. 1 is a longitudinal, sectional view of a filter rod of the present invention.

Referring to FIG. 1, filter rod 10 has a cylindrical shape. Typically, the filter rod 10 has a length which ranges from about 80 mm to about 140 mm, and a circumference which ranges from about 16 mm to about 28 mm. The filter rods then can be divided at predetermined intervals to provide filter elements, or filter element segments, for cigarettes. The filter rod 10 includes filter material 13 (described in greater detail hereinafter) and an outer wrap 15, which circumscribes the filter material. Normally, the outer wrap is a non-porous paper plug wrap, such as Ref. No. 646 available from Kimberly-Clark Corp.; or porous paper plug wrap, such as Ref. Nos. 70MI, 70M2 or 260 M1 available from Kimberly-Clark Corp.

The filter rod 10 normally is manufactured using known rod making techniques. A preferred manner for providing filter rod 10 involves producing folds, creases grooves and partial tears in a web of sheet-like filter material and forming a rod therefrom, as set forth by Keith et al in U.S. Pat. No. 4,283,186 at col. 4, line 50 through col. 5, line 6. Preferred filter materials in the form of a web of paper have a series of longitudinally extending grooves imparted in the paper web. Such grooves preferably have partial tears therein. The spacing of the grooves along the length of the paper web can affect the ultimate pressure drop of the filter element. For example, longitudinally extending grooves which are positioned fairly far apart tend to provide for a filter element having a relatively low pressure drop. It is also possible to gather or pleat a web of paper filter material by employing the apparatus described in U.S. Pat. No. 4,807,809 to Pryor et al. The filter material also can be provided in strand form from a paper web using the apparatus described in U.S. Pat. application Ser. No. 049,200, filed May 12, 1987. As such, the filter material is provided in a form or configuration capable of exhibiting filtration characteristics.

Figure 2:
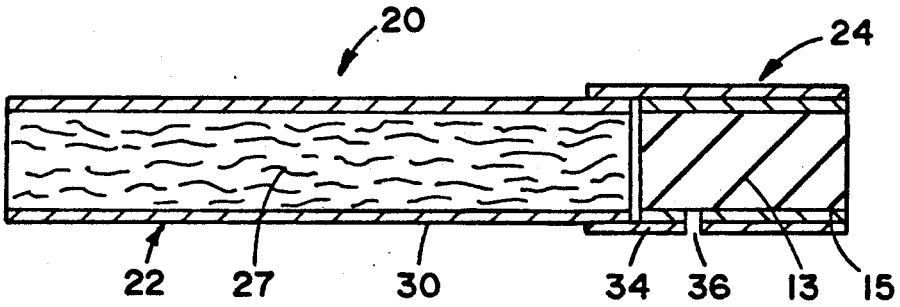
FIGS. 2 and 3 are longitudinal, sectional views of cigarettes of the present invention.

Referring to FIG. 2, cigarette 20 includes a tobacco rod 22 and a filter element 24. The tobacco rod 22 includes a charge or roll of smokable material 27 contained in a circumscribing wrapping material 30, such as cigarette paper. Typically, the tobacco rod 22 has a length which ranges from about 55 mm to about 85 mm, and a circumference which ranges from about 16 to about 28 mm. The ends of the tobacco rod are open to expose the smokable material. The filter element 24 is positioned adjacent one end of the tobacco rod 22 such that the filter element is aligned with the tobacco rod in an end-to-end relationship, preferably abutting one another. The filter element has a cross sectional shape similar to that of the tobacco rod. The filter element 24 is a segment of the filter rod referred to previously with respect to FIG. 1, and as such, includes filter material 13 and outer plug wrap 15. The filter material 13 is described in greater detail hereinafter. The ends of the filter element are open to allow the passage of air and smoke therethrough. Typically, the filter element has a length which ranges from about 15 mm to about 35 mm. The filter element 24 is attached to the tobacco rod 22 using tipping material 34, which circumscribes both the filter element and an adjacent region of the tobacco rod. The inner surface of the tipping material is fixedly secured (e.g., using an adhesive) to the outer surface of the plug wrap of the filter element and an adjacent region of the tobacco rod. The tipping material circumscribes the tobacco rod over a longitudinal length (e.g., about 4 mm) which is sufficient to provide good attachment of the filter element to the tobacco rod. Examples of tipping materials are papers available as Ref. No. GSR 249 from Kimberly-Clark Corp. and Ref. No. 30132 from Ecusta Corp. Such a cigarette can be provided using commercially available cigarette making machinery. Air dilution perforations 36 can be provided through the tipping material 34 and plug wrap 15 if desired using known "on-line" or "off-line" techniques.

Figure 3:
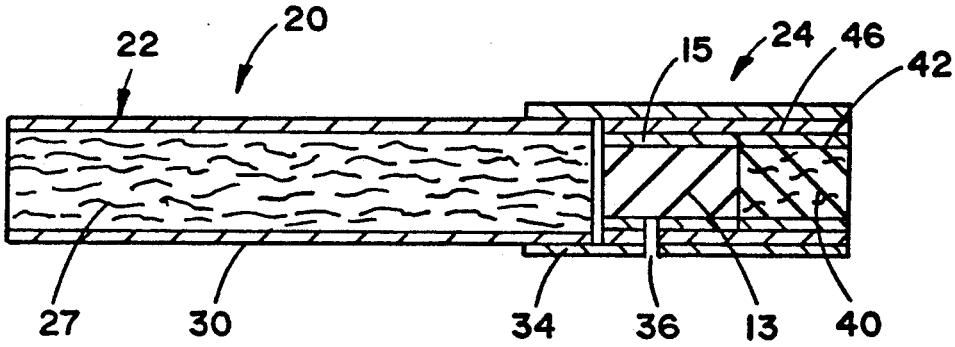

Referring to FIG. 3, cigarette 20 is generally similar to the cigarette previously described with respect to FIG. 2, except that the filter element 24 includes two filter element segments. The first filter element segment is positioned adjacent one end of the tobacco rod 22, and the second filter element segment is positioned adjacent one end of the first segment. Normally, the length of each segment ranges from about 5 mm to about 30 mm. The first segment includes filter material 13 (described in greater detail hereinafter) and circumscribing plug wrap 15. The second segment includes second filter material 40 and circumscribing plug wrap 42. The second filter material preferably is a cellulose acetate tow (e.g., 8 denier per filament, 40,000 total denier). The two segments are axially aligned in an end-to-end relationship, preferably abutting one another; and are maintained in place by circumscribing outer plug wrap material 46. The inner surface of the outer plug wrap 46 is fixedly secured to the outer surfaces of the plug wraps of the respective filter segments. The filter segments can be provided in the desired alignment using plug tube combination machinery which is familiar to the skilled artisan. Air dilution perforations 36 can be provided through tipping material 34, outer plug wrap 46 and inner plug wraps 15 and/or 42, depending upon the length of each filter segment.

The wrapping material which circumscribes the charge of smokable material can vary. Examples of suitable wrapping materials are cigarette paper wrappers available as Ref. Nos. 719, 754, 756, 854 and 856 from Kimberly-Clark Corp. Also suitable are cigarette paper wrappers available as P-2123-101, P-2123-102, P-2123-104, P-2123-106, P-2123-107, P-2123-108, P-2123-109, P-2123-111, P-2123-112, P-2123-114, from Kimberly-Clark Corp.; and cigarette paper wrappers available as Ecusta Experimental Paper Nos. TOD 01788, TOD 03363, TOD 03732, TOD 03957, TOD 03949, TOD 03950, TOD 03953, TOD 03954, TOD 04706, TOD 04742 and TOD 04708 from Ecusta Corp. Preferred paper wrappers have low inherent air permeabilities (e.g., permeabilities of less than about 15 CORESTA units). A particularly preferred paper wrapper is a low permeability, high basis weight paper having a high surface area calcium carbonate filler and a relatively high application of potassium succinate burn additive. Such a paper is available as P-2123-114 from Kimberly-Clark Corp. Another particularly preferred paper wrapper (i) has a low inherent permeability, high basis weight paper having a calcium carbonate and magnesium hydroxide filler, and a potassium acetate burn chemical, and (ii) has been electrostatically perforated so as to have a relatively high net permeability (e.g., a net permeability of greater than 50 CORESTA units). Such papers are provided by electrostatically perforating papers available as Ecusta Experimental Paper Nos. TOD 03732 and TOD 04742 from Ecusta Corp.

The smokable material can vary. Typical smokable materials are employed as cut filler as is common in cigarette manufacture (e.g., as shreds or strands of tobacco material). Examples of preferred types of tobacco include flue-cured, Burley, Oriental and Maryland tobaccos. Generally, the tobacco material has been aged. The tobacco material can have the form of tobacco laminae in cut filler form, processed tobacco stems, reconstituted tobacco filler, volume expanded tobacco filler, or the like. Tobacco substitutes, such as smokable materials including carbonized or pyrolyzed components and/or inorganic filler components, also can be employed. The aforementioned materials can be employed separately, or as blends thereof. The nicotine content of the smokable material which is employed to provide the ultimate cigarette can vary. Various high nicotine content smokable materials and blends are described by Lawson et al in U.S. Pat. No. 4,836,224 at col. 5, line 11 through col. 6, line 32.

The preferred filter material for filter elements of the present invention is a gathered or pleated paper. Preferred papers include (i) a cellulosic basic web, and (ii) an inorganic filler, which may include a metal hydroxide (e.g., magnesium hydroxide). Examples of suitable papers are available as Ecusta Experimental Paper Nos. TOD 03363, TOD 01788, TOD 03732, TOD 03996, TOD 03997 and TOD 03981. See, U.S. Pat. No. 4,450,847 to Owens. Especially preferred papers include flax fibers, calcium carbonate filler and magnesium hydroxide filler. Typically, such preferred papers include about 40 to about 90 weight percent, preferably about 50 to about 70 weight percent cellulosic material (e.g., flax), about 10 to about 50 weight percent, preferably about 20 to about 30 weight percent calcium carbonate, and up to about 40 weight percent, preferably about 10 to about 30 weight percent magnesium hydroxide. If desired, additives including tobacco extracts, triacetin, glycerine, menthol, carbon fibers, carbon particles, and the like, can be incorporated into the filter material. Such additives can be incorporated into the paper during its manufacture, or applied to the paper after manufacture is complete.

The preferred filter material is provided as a web from a bobbin. In order to manufacture a filter rod of 24.5 mm circumference, the width of the web typically ranges from about 13 cm to about 40 cm.

The preferred filter material has a low porosity. In particular, the filter material is a paper which exhibits an inherent air permeability of less than 15 CORESTA units, preferably about 10 CORESTA units or less.

The weight of the filter elements can vary. Typical filter elements having a length of about 20 mm and a circumference of about 24.5 mm normally weigh from about 0.2 g to about 0.5 g, preferably about 0.3 g to about 0.4 g.

Typical filter materials have the form of paper having a thickness greater than about 0.05 mm, preferably from about 0.06 mm to about 0.08 mm. Typical filter materials have the form of paper having a basis weight of about 30 $g/m^2$ to about 80 $g/m^2$, preferably about 40 $g/m^2$ to about 70 $g/m^2$.

Paper filter materials exhibit a pH above 7. For a method determining the pH of paper, see TAPPI Method T 509 om-88, from TAPPI Test Methods, Vol. 1 (1989). Typical pH values for preferred filter materials are greater than about 9, and preferably range from about 9.5 to about 11.5. Filter materials having a pH above about 9 are desirable because it is believed that such filter materials tend to be very inefficient in filtering the flavorful basic components of mainstream tobacco smoke, and also tend to enhance the elusion of flavorful basic components of the particulate matter and semi-volatile particulate matter of tobacco smoke.

Filter rods of the present invention exhibit a desirably high pressure drop. For example, a typical rod having a 120 mm length, 24.5 mm circumference and a weight of about 1 g to about 2.2 g, preferably about 1.2 g to about 1.5 g, exhibits a pressure drop of from about 400 mm to about 1,000 mm, preferably about 600 mm to about 800 mm of water determined at an airflow rate of 17.5 cc/sec. using an encapsulated pressure drop tester, sold commercially as Model No. FTS-300 by Filtrona Instruments and Automation Ltd. Preferred filter elements exhibit a pressure drop of greater than about 40 mm, often greater than about 45 mm, of water pressure drop, per 0.1 gram of filter material, measured at an airflow rate of 17.5 cc/sec.

Filter elements which are provided from filter rods of the present invention exhibit a relatively low filtration efficiency for particulate matter of mainstream tobacco smoke per unit weight of filter element. For example, a filter element having a 21 mm length 24.5 mm circumference and a weight of about 0.37 g exhibits a particulate mass removal filtration efficiency of less than about 55 percent, normally about 50 percent or less. See, Keith in Schemeltz's *The Chemistry of Tobacco and Tobacco Smoke*, p. 157 (1972). Preferred filter elements exhibit a filtration efficiency for particulate matter of mainstream tobacco smoke of less than about 15 percent, often less than 13 percent, per 0.1 gram of filter material.

Cigarettes of the present invention preferably are air diluted or ventilated. Preferably, the cigarettes are air diluted up to about 80 percent, more preferably between about 30 and about 70 percent. As used herein, the term "air dilution" is the ratio (expressed as a percentage) of the volume of air drawn through the air dilution means (e.g., perforations) to the total volume of air and smoke drawn through the cigarette and exiting the extreme mouthend portion of the cigarette. See, Selke et al, Beitr. Zur Tabak. In., Vol. 4, p. 193 (1978).

The following examples are provided in order to further illustrate various embodiments of the invention but should not be construed as limiting the scope thereof. Unless otherwise noted, all parts and percentages are by weight.

EXAMPLE 1

Cigarettes substantially as shown in FIG. 1 are provided as follows:

Cigarettes each have lengths of about 84 mm (i.e., a tobacco rod length of 63 mm and a filter element length of 21 mm) and circumferences of about 24.85 mm.

The tobacco rod includes a charge of strands of flue-cured tobacco laminae cut at about 32 cuts per inch, and having an aqueous casing of 2 percent glycerine applied thereto. The nicotine content of the tobacco is about 4.65 percent. The amount of tobacco filler in each tobacco rod weighs about 780 mg. The tobacco filler is circumscribed by a cigarette paper available as Ref. No. 856 from Ecusta Corp.

Sample Nos. 1 through 3 are manufactured from the aforementioned tobacco rods, and filter elements which are provided using (i) a non-porous paper plug wrap available as Ref. No. 646 from Ecusta Corp., and (ii) a filter material in the form of about a 9 inch width of a magnesium hydroxide, calcium carbonate and flax paper available as Experimental Paper No. TOD 03994 from Ecusta Corp. The filter elements are provided from filter rods which are manufactured using an apparatus generally as described by Keith et al in U.S. Pat. No. 4,283,186 at col. 4, line 50 through col. 5, line 6. As such, the filter material has a series of longitudinally extending grooves which have partial tears which are imparted therein. The longitudinally extending grooves are positioned about 3 mm apart. Each filter element (i.e., 21 mm in length and about 24.5 mm in circumference) weighs about 0.37 g.

The filter element is attached to the tobacco rod using non-porous tipping paper which circumscribes the filter element and about 3 mm along the length of the tobacco rod. Cigarettes so described are manufactured using a Pilot Cigarette Maker from Hauni-Werke Korber & Co. KG. Sample No. 1 is not air diluted. Sample Nos. 2 and 3 are air diluted by providing a ring of laser perforations around the tipping paper and plug wrap about 13 mm from the extreme mouthend of the filter element using a Laboratory Laser Perforator from Hauni-Werke Korber & Co. KG.

For comparison purposes, Sample Nos. C-1 through C-3 are manufactured using cellulose acetate tow (3.3 denier per filament ; 44,000 total denier) filter elements rather than the Experimental Paper No. TOD 03994 paper filter elements. The cellulose acetate tow includes about 8.8 percent triacetin. Such comparative filters are manufactured using conventional cigarette filter making techniques. Each comparative filter element (i.e., 21 mm in length and about 24.5 mm in circumference) weighs about 0.16 g. Other than the differing filter materials, cigarettes of Sample Nos. C-1 through C-3 are essentially identical to the cigarettes of Sample Nos. 1 through 3. Sample No. C-1 is not air diluted. Sample Nos. C-2 and C-3 are air diluted as are Sample Nos. 2 and 3, respectively.

For comparison purposes, Sample Nos. C-4 through C-6 are manufactured using a gathered non-woven polypropylene web filter elements rather than the Experimental Paper No. TOD 03994 paper filter elements. Such comparative filters are manufactured by gathering or pleating a 11.75 inch wide web of the non-woven polypropylene, available as P-100 from Kimberly-Clark Corp., using the filter rod forming apparatus described in Example 1 of U.S. Pat. No. 4,807,809 to Pryor et al. Each comparative filter element (i.e., 21 mm in length and about 24.3 mm in circumference) weighs about 0.17 g. Other than the differing filter materials, cigarettes of Sample Nos. C-4 through C-6 are essentially identical to the cigarettes of Sample Nos. 1 through 3. Sample No. C-4 is not air diluted. Sample Nos. C-5 and C-6 are air diluted as are Sample Nos. 2 and 3, respectively.

The cigarettes are smoked under FTC smoking conditions. FTC smoking conditions consist of 35 ml puffs of 2 seconds duration, taken every 60 seconds. Pressure drop and puff count values, as well as FTC "tar", nicotine and carbon monoxide values, for the various cigarettes are set forth in Table I.

TABLE I

| Sample No. | Air Dilution (%) | Puff Count | FTC[1] CO | FTC[2] "Tar" | FTC[2] Nicotine | Pressure[3] Drop |
|---|---|---|---|---|---|---|
| 1 | 0 | 10.1 | 14.4 | 16.8 | 2.55 | 236 |
| 2 | 32 | 10.7 | 10.6 | 12.6 | 2.05 | 189 |
| 3 | 71 | 12.1 | 4.0 | 5.0 | 0.86 | 139 |
| C-1* | 0 | 9.6 | 14.1 | 21.6 | 3.43 | 103 |
| C-2* | 36 | 10.5 | 10.2 | 17.1 | 2.78 | 81 |
| C-3* | 70 | 11.7 | 3.6 | 6.9 | 1.32 | 63 |
| C-4* | 0 | 10.5 | 15.1 | 30.6 | 4.45 | 67 |
| C-5* | 30 | 10.5 | 11.3 | 26.0 | 4.00 | 41 |
| C-6* | 66 | 12.2 | 3.3 | 8.9 | 1.68 | 24 |

*Not an example of the invention.
[1]FTC carbon monoxide yields reported in mg/cigarette.
[2]FTC "tar" and FTC nicotine yields reported in mg/cigarette.
[3]Pressure drop is the pressure drop of the cigarette reported in mm $H_2O$ determined at an air flow rate of 17.5 cc/sec. using a pressure drop tester, sold commercially as Model No. FTS-300 by Filtrona Instruments and Automation Ltd.

The data in Table I indicate that the filter element of the present invention provides low filtration efficiencies for "tar" and nicotine, on a per unit weight basis. In particular, filter elements of Sample Nos. 1 through 3 provide filtration efficiencies for "tar" and nicotine which are comparable to those filtration efficiencies of filter elements provided from a gathered non-woven polypropylene web (i.e., a low filtration efficiency material), when compared on the basis of the weight of the filter material. See, Sample Nos. C-4 through C-6.

The data in Table I also indicate that the filter element of the present invention provides a relatively high pressure drop, on a per unit weight basis. In particular, filter elements of Sample Nos. 1 through 3 provide pressure drops of filter elements provided from cellulose acetate tow, when compared on the basis of the weight of the filter material. See, Sample Nos. C-1 through C-3.

EXAMPLE 2

Cigarettes substantially as shown in FIG. 1 are provided as follows:

Cigarettes each have lengths of about 84 mm (i.e., a tobacco rod length of 57 mm and a filter element length of 27 mm) and circumferences of about 24.85 mm.

The tobacco rod includes a charge of strands of an "American blend" of tobacco cut filler provided at about 32 cuts per inch. The nicotine content of the blend is about 2.7 percent. The amount of tobacco filler in each tobacco rod weighs about 650 mg.

Sample No. 4 is manufactured from the aforementioned tobacco blend, a circumscribing paper wrap available as P-2123-114 from Kimberly-Clark Corp., and filter elements which are provided using (i) a non-porous paper plug wrap available as Ref. No. 646 from Ecusta Corp., and (ii) a filter material in the form of a magnesium hydroxide, calcium carbonate and flax paper available as Experimental Paper No. TOD 03994 from Ecusta Corp. The filter elements are provided from filter rods which are manufactured using the apparatus described in Example 1. Each filter element (i.e., 27 mm in length and about 24.5 mm in circumference) weighs about 0.48 g.

The filter element is attached to the tobacco rod using non-porous tipping paper which circumscribes the filter element and about 3 mm along the length of the tobacco rod. Cigarettes so described are manufactured using a Pilot Cigarette Maker from Hauni-Werke Korber & Co. KG. Sample No. 4 is air diluted about 50 percent by providing a ring of laser perforations around the tipping paper and plug wrap about 13 mm from the extreme mouthend of the filter element using a Laboratory Laser Perforator from Hauni-Werke Korber & Co. KG.

For comparison purposes, Sample No. C-7 is manufactured using cellulose acetate tow (2.7 denier per filament ; 48,000 total denier) filter elements rather than the Experimental Paper No. TOD 03994 paper filter elements. The cellulose acetate tow includes about 9 percent triacetin. Such comparative filters are manufactured using conventional cigarette filter making techniques. Each comparative filter element (i.e., 27 mm in length and about 24.5 mm in circumference) weighs about 0.20 g. Sample No. C-7 is air diluted as is Sample No. 4. Other than the differing filter materials, Sample No. C-7 is essentially identical to Sample No. 4.

For comparison purposes, Sample No. C-8 is manufactured as is Sample No. C-7, except that the circumscribing paper wrapper is Ref. No. 856 from Ecusta Corp.

The cigarettes are smoked under FTC smoking conditions. The cigarettes also are tested for sidestream "tar" and nicotine using an apparatus and technique substantially as described by Proctor et al in *Analyst*, Vol. 113, p. 1509 (1988). Pressure drop and puff count values, as well as FTC "tar", nicotine and carbon monoxide, and sidestream "tar" and nicotine values, for the various cigarettes are set forth in Table II.

TABLE II

| | Sample No. | | |
|---|---|---|---|
| | 4 | C-7* | C-8* |
| Puff Count | 7.4 | 7.5 | 7.4 |
| FTC CO[1] | 10.8 | 10.6 | 7.3 |
| FTC "Tar"[2] | 5.2 | 7.5 | 6.8 |
| FTC Nicotine[2] | 0.59 | 0.88 | 0.79 |
| Pressure Drop[3] | 207 | 109 | 111 |
| Sidestream "Tar" (mg) | 15.9 | 15.0 | 24.1 |
| Sidestream Nicotine (mg) | 4.80 | 4.26 | 5.83 |

*Not an example of the invention.
[1-3] See, Footnotes [1-3], Table I.
[4] See, Proctor et al, Analyst, Vol. 113, p. 1509 (1988).

The data in Table II indicate that the filter element of the present invention provides low filtration efficiencies for "tar" and nicotine on a per unit weight basis.

The data in Table II also indicate that cigarettes manufactured using the P-2123-114 paper wrap generate relatively low levels of sidestream "tar" and nicotine. The cigarettes employing the P-2123-114 paper exhibit relatively low levels of visible sidestream smoke.

What is claimed is:

1. A filter element for a smoking article, the filter element having a filter material and a circumscribing outer wrap, the filter material (i) having the form of a paper including a metal hydroxide filler, and (ii) exhibiting a pH of greater than about 9.

2. The filter element of claim 1 wherein the filter material exhibits a pH between about 9.5 and about 11.5.

3. The filter element of claim 1 wherein the metal hydroxide filler is magnesium hydroxide.

4. The filter element of claim 1 or 3 wherein the filter material has a thickness greater than about 0.05 mm.

5. The filter element of claim 1 or 3 wherein the filter material has a thickness from about 0.06 mm to about 0.08 mm.

6. The filter element of claim 1 or 3 wherein the filter material has a basis weight of about 40 $g/m^2$ to about 70 $g/m^2$.

7. The filter element of claim 1 or 3 wherein the filter material thereof has an air permeability of less than about 15 CORESTA units.

8. The filter element of claim 4 wherein the filter material thereof has an air permeability of less than about 15 CORESTA units.

9. A filter element for a smoking article, the filter element having a filter material and a circumscribing outer wrap, the filter material (i) having the form of a paper including about 50 to about 70 weight percent cellulosic material, about 20 to about 30 weight percent calcium carbonate, and about 10 to about 40 weight percent magnesium hydroxide metal hydroxide filler, and (ii) exhibiting a pH of greater than about 9.

10. The filter element of claim 1 or 3 having a circumference of about 16 mm to about 28 mm, and a length of about 5 mm to about 30 mm.

11. A filter element for a smoking article, the filter element having a filter material and a circumscribing outer wrap, the filter material (i) having the form of a paper having an air permeability of less than about 15 CORESTA units, and (ii) exhibiting a pH of greater than about 9.

12. The filter element of claim 11 wherein the filter material exhibits a pH between about 9.5 and about 11.5.

13. The filter element of claim 11 wherein the filter material has a thickness greater than about 0.05 mm.

14. The filter element of claim 11 wherein the filter material has a thickness from about 0.06 mm to about 0.08 mm.

15. The filter element of claim 11 or 13 wherein the filter material has a basis weight of about 40 $g/m^2$ to about 70 $g/m^2$.

16. A filter element for a smoking article having a filter material and a circumscribing outer wrapper, the filter element exhibiting:

(i) a pressure drop of greater than about 40 mm of water at an airflow rate of 17.5 cc/sec. per 0.1 gram of filter material; and (ii) a filtration efficiency for particulate matter of mainstream tobacco smoke of less than about 15 percent per 0.1 gram of filter material.

17. The filter element of claim 16 which exhibits a pressure drop of greater than about 45 mm of water at an airflow rate of 17.5 cc/sec. per 0.1 gram of filter material.

18. The filter element of claim 16 or 17 which exhibits a filtration efficiency for particulate matter of mainstream tobacco smoke of less than about 13 percent per 0.1 gram of filter material.

19. The filter element of claim 16 having a circumference of about 16 mm to 28 mm, and a length of about 5 to about 30 mm.

20. The filter element of claim 16 wherein the filter material has the form a paper.

21. The filter element of claim 19 wherein the filter material is a paper which includes magnesium hydroxide filler.

22. The filter element of claim 20 or 21 wherein the filter material exhibits a pH of greater than about 9.

23. The filter element of claim 20 or 21 wherein the filter material thereof has an air permeability of less than about 15 CORESTA units.

24. The filter element of claim 20 or 21 wherein the filter material thereof has a thickness greater than about 0.05 mm.

25. A cigarette having a smokable rod including a charge of smokable material contained in a circumscribing wrapping material, the cigarette comprising a filter element adjacent one end of the smokable rod, the filter element including a filter material (i) having the form of a paper including a metal hydroxide filler, and (ii) exhibiting a pH of greater than about 9.

26. The cigarette of claim 25 wherein the metal hydroxide filler is magnesium hydroxide.

27. The cigarette of claim 25 or 26 wherein the filter material has a thickness greater than about 0.05 mm.

28. The cigarette of claim 25 or 26 wherein the filter material thereof has an air permeability of less than about 15 CORESTA units.

29. The cigarette of claim 28 wherein the filter material thereof has an air permeability of less than about 15 CORESTA units.

30. The cigarette of claim 25 further being air diluted up to about 80 percent.

31. A cigarette having a smokable rod including a charge of smokable material contained in a circumscribing wrapping material, the cigarette comprising a filter element adjacent one end of the smokable rod, the filter element having at least two filter element segments, wherein one of the filter segments includes a filter material (i) having the form of a paper including a metal hydroxide filler, and (ii) exhibiting a pH of greater than about 9.

32. The cigarette of claim 31 wherein the metal hydroxide filler is magnesium hydroxide.

33. The cigarette of claim 31 or 32 further being air diluted up to about 80 percent.

34. A cigarette having a smokable rod including a charge of smokable material contained in a circumscribing wrapping material, the cigarette comprising a filter element adjacent one end of filter material (i) having the form of a paper having an air permeability of less than about 15 CORESTA units, and (ii) exhibiting a pH of greater than about 9.

35. The cigarette of claim 34 further being air diluted up to about 80 percent.

36. A cigarette having a smokable rod including a charge of smokable material contained in a circumscribing wrapping material, the cigarette comprising a filter element adjacent one end of the smokable rod, the filter element having at least two filter element segments, wherein one of the filter element segments includes a filter material (i) having the form of a paper having an air permeability of less than about 15 CORESTA units, and (ii) exhibiting a pH of greater than about 9.

37. The cigarette of claim 36 further being air diluted up to about 80 percent.

38. A cigarette having a smokable rod including a charge of smokable material contained in a circumscribing wrapping material, the cigarette comprising a filter element adjacent one end of the smokable rod, the filter element exhibiting:

(i) a pressure drop of greater than about 40 mm of water per 0.1 gram of filter material measured at an airflow rate of 17.5 cc/sec.; and (ii) a filtration efficiency for particulate matter of mainstream tobacco smoke of less than about 15 percent per 0.1 gram of filter material.

39. The cigarette of claim 38 further being air diluted up to about 80 percent.

40. The cigarette of claim 38 wherein the filter element exhibits a pressure drop of greater than about 45 mm of water per 0.1 gram of filter material measured at an airflow rate of 17.5 cc/sec.

41. The cigarette of claim 38 or 40 wherein the filter element exhibits a filtration efficiency for particulate matter of mainstream tobacco smoke of less than about 13 percent per 0.1 gram of filter material.

42. The cigarette of claim 38 wherein the filter element consists essentially of filter material and a circumscribing outer wrapper.

43. The cigarette of claim 42 wherein the filter material has the form of a paper which includes magnesium hydroxide filler.

* * * * *